US005344374A

United States Patent [19]

Telle

[11] Patent Number: 5,344,374

[45] Date of Patent: Sep. 6, 1994

[54] VARIABLE RESISTANCE EXERCISING APPARATUS

[76] Inventor: Jerome R. Telle, 13920 W. Alaska Dr., Lakewood, Colo. 80228

[21] Appl. No.: 893,200

[22] Filed: Jun. 2, 1992

[51] Int. Cl.[5] ..... A63B 21/06

[52] U.S. Cl. ..... 482/97; 482/112; 482/137; 482/139

[58] Field of Search ..... 482/1-9, 482/97-103, 104, 106, 108, 112-113, 133-139, 908; 128/28 R

[56] References Cited

U.S. PATENT DOCUMENTS

| | | | |
|---|---|---|---|
| 3,285,070 | 11/1966 | McDonough | 482/138 X |
| 3,573,865 | 6/1971 | Annas . | |
| 4,235,437 | 11/1980 | Ruis et al. | 482/137 X |
| 4,357,010 | 11/1982 | Telle | 482/97 |
| 4,585,229 | 4/1986 | Brasher | 482/106 |
| 4,629,185 | 12/1986 | Amann | 482/113 |
| 4,650,185 | 3/1987 | Cartwright . | |
| 4,730,829 | 3/1988 | Carlson | 482/137 X |
| 4,768,783 | 9/1988 | Engalitcheff, Jr. | 482/139 |
| 4,799,670 | 1/1989 | Williamson | 482/97 |
| 4,817,943 | 4/1989 | Pipasik | 482/137 X |
| 4,863,161 | 5/1989 | Telle . | |
| 4,872,668 | 10/1989 | McGillis et al. | 482/113 |
| 4,872,670 | 10/1989 | Nichols | 482/97 X |
| 4,949,951 | 8/1990 | Deola | 482/138 |
| 5,042,799 | 8/1991 | Stanley | 482/112 X |
| 5,108,095 | 4/1992 | Nichols | 482/97 X |
| 5,116,297 | 5/1992 | Stonecipher | 482/97 |
| 5,179,939 | 1/1993 | Donovan et al. | 482/4 |

FOREIGN PATENT DOCUMENTS

| | | | |
|---|---|---|---|
| 2581550 | 11/1986 | France | 482/137 |
| 2223686 | 4/1990 | United Kingdom | 482/137 |

*Primary Examiner*—Robert Bahr

*Attorney, Agent, or Firm*—John E. Reilly

[57] ABSTRACT

A hand-held lift device forming a part of a weight lifting apparatus in performing double-joint multiple function exercises with the aid of an inertial resistance mechanism which is made up of the combination of a pivotally mounted linear actuator and dampener member, both of which can be adjusted to control the amount of inertial resistance to each exercise being performed, and a flexible cable serves as the resistance member between the linear actuator, dampener and lift device.

18 Claims, 7 Drawing Sheets

VARIABLE RESISTANCE EXERCISING APPARATUS

SPECIFICATION

This invention relates to exercise apparatus; and more particularly relates to a novel and improved variable resistance exercise apparatus which is specifically adaptable for use in performing double joint multiple function exercises with the aid of an inertial resistance mechanism.

BACKGROUND AND FIELD OF THE INVENTION

In exercising different muscles there are a number of muscle structures which traverse two different joints of the body and assist in movement about those joints, and such movements are customarily referred to as double joint muscle movements. For example, the biceps flex and supinate the forearm at the elbow and flex the upper arm at the shoulder. Other muscles which perform similar functions are the triceps, quadriceps and hamstrings. In exercising the double joint muscles, the resistance provided by cam and free weight types of equipment do not fully meet the needs of the athlete, and in the past the inertial devices have not met various resistance needs and particularly in order to fully and appropriately stress a given muscle throughout its entire range of movement.

In terms of correct resistance, an appropriate force must be developed which increases or decreases commensurate with the athlete's changing potentials throughout the course of exercise; for example, as successive repetitions are performed, the fatigue factor will play an important part and dictate variations in resistance to muscle movement. For this reason, it is important to compensate for any decaying effect throughout the latter portions of successive movements.

Research consistently demonstrates that, due to fatigue, the force an athlete can exert during a series of movements changes in relative pattern and level. In particular, as successive repetitions are performed, the athlete's force generating capabilities decrease or "differentially decay" faster during the latter portions of such movements.

In my prior U.S. Pat. No. 4,863,161, a combination of inertial resistance and isokinetics was relied upon to a great extent to provide correct resistance to muscle movement. Other devices which have operated on similar principles are disclosed in U.S. Pat. Nos. 3,573,865 to Annas and 4,650,185 to Cartwright. U.S. Pat. No. 3,573,865 to Annas is representative of numerous exercise machines which have been devised in the past and which employ a linear force actuator but do not compensate for the differential decaying effect which typically occurs as successive repetitions are performed by the exerciser.

It is therefore desirable to provide an inertial resistance which meets the varied and changing demands of the athlete without resorting to the use of artificial means of resistance, such as, isokinetic or electrical clutch mechanisms and which will most efficiently compensate for any differential decaying effect.

SUMMARY OF THE INVENTION

Accordingly, it is an object of the present invention to provide for a novel and improved exercise machine which is capable of adjusting to the changing needs of the exerciser through each exercise performed and which is specifically adaptable for use in the development of double joint multiple function muscles.

Another object of the present invention is to provide for an exercise apparatus which is capable of offering full range of movement resistance to double joint muscular movement as well as controlled variations in inertial resistance to accommodate the different and changing force requirements during each exercise.

A further object of the present invention is to provide in exercise apparatus for novel and improved means to control movement patterns throughout a full range of motion of the muscle or muscles to be exercised coupled with the correct inertial resistance to fully stress the given muscle throughout the entire range of motion; and further wherein means are provided to modify the resistance to conform to a predetermined force profile to meet various exercise objectives as well as to compensate for any differential decaying effects.

It is a further object of the present invention to provide in exercise apparatus for a hand-held device which will allow a controlled change or variation in hand positions during an exercise movement while maintaining an applied resistance perpendicular to the direction of movement throughout the full range.

An additional object of the present invention is to provide in exercise apparatus for a hand-held device which allows total hand position freedom in performing double joint muscle movements in further combination with inertial force profile regulating means which will establish a predetermined pattern of movement and resistance in performing double joint muscle exercises.

In accordance with the present invention, there has been devised for use in a weight lifting apparatus a resistance member which is engageable with a lift device to be lifted by an exerciser and movable through a predetermined range of movement, the resistance member including a cable affixed at one end to the lift device and a dampener member, and arm members are interposed between the dampener and cable to establish a predetermined but variable level of resistance to movement of the lift device. Preferably, the arm members are substantially perpendicular to one another and include adjustment means for adjusting the connection of the end of the cable opposite to that connected to the lift device including adjustment means to vary the point of attachment of the cable and the location of a weight bearing device to the arm members in order to establish a predetermined level of resistance to movement of the lift device. In addition, one of the arm members is pivotally connected to a fixed support member to establish a fulcrum about which the arm members are pivoted in response to movement of the lift device and cable.

The above and other objects of the present invention will become more readily appreciated and understood from a consideration of the following detailed description of a preferred embodiment when taken together with the accompanying drawings wherein:

DETAILED DESCRIPTION OF THE PREFERRED EMBODIMENT

Figure 1:
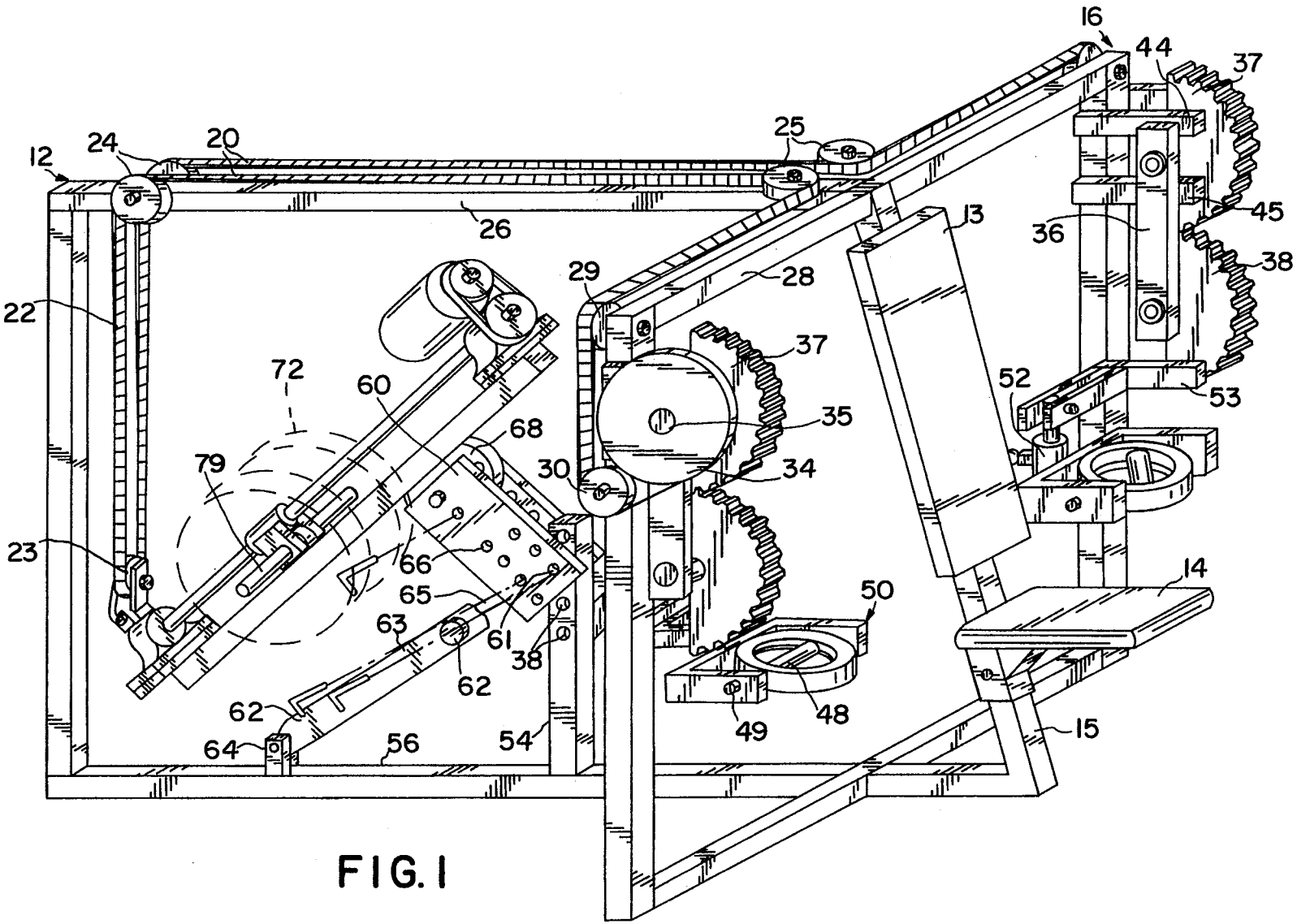
FIG. 1 is an isometric view of a preferred form of exercising apparatus in accordance with the present invention.

Referring in more detail to the drawings, a preferred form of exerciser apparatus 10 is illustrated in FIGS. 1–13. As a setting for the present invention, the preferred form of exerciser apparatus 10 is designed for carrying out double joint muscle movements of the forearm and biceps but is adaptable for use in carrying out other exercises with different muscle groups. The preferred form of apparatus comprises a generally T-shaped framework including an open, generally rectangular center frame 12 having an inclined backrest 13 and seatrest 14 along the one inclined end 15 of the center frame 12; and a cross frame 16 is permanently affixed across and slightly behind the inclined end 15 of the center frame 12.

Figure 7:
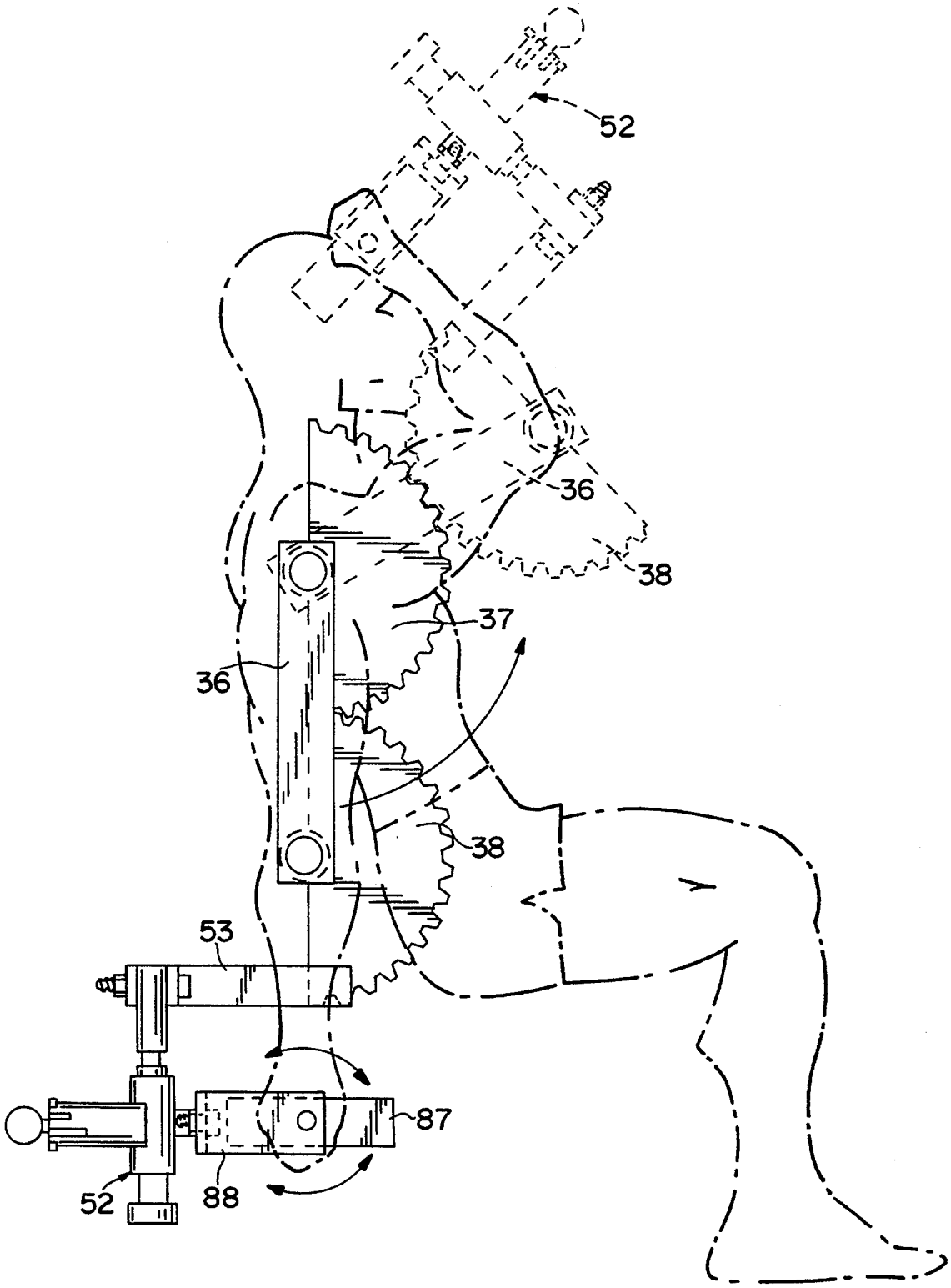
FIG. 7 is a schematic view illustrating the range of movement through which the exercise apparatus of the present invention follows with an exerciser illustrated in dotted form.

A resistance system includes a primary resistance member in the form of a flexible non-elastic cable or band 20 having a looped cable end 22 trained over a pulley 23, opposite sides of the cable extending upwardly from the pulley 23 with each side trained over a rear pulley 24 and a front pulley 25 journaled at opposite ends of top frame 26 of the frame 12. The cable undergoes in succession a right angle turn around the pulley 25 to advance along the top horizontal member 28 of the cross frame 16, a right angle turn over a pulley 29 at upper outside corners of the cross frame 16 to extend downwardly along a portion of vertical leg 32 of the cross frame 16, and finally a forward and upward turn around a pulley 30 into a drive pulley 34. Each set of the pulleys 23, 24, 25, 29 and 30 is journaled to the frame members as shown, and the drive pulley 34 is keyed for rotation on a shaft 35, as best seen from FIGS. 1 and 11, and the shaft 35 extends transversely through bearings 33 and through upper ends of a shorter arm 36 and a longer arm 36', the latter affixed to the pulley 34. An upper gear 37 is journaled on the shaft 35 between the bearings, and a collar 46 is affixed to the end of the shaft 35. The upper gear 37 intermeshes with a lower gear 38 journaled on shaft 39, the shaft 39 extending transversely through and affixed to lower ends of the arms 36 and 36', and bearings 33' are interposed between the lower gear 38 and each of the arms 36 and 36'. A lower collar 46 corresponding to the upper collar 46 is affixed to the end of the lower shaft 39, also, and slip washers 47 are positioned between each of the bearings 33, 33' and arms 36, 36' to permit independent rotation therebetween. The upper bearings 33 are similarly interposed between the upper gear 37, and the upper gear 37 is affixed to and is suspended between upper and lower brackets 44 and 45 so that the arms 36 and 36' are free to rotate along with the lower drive gear 38 about the upper gear 37, as shown in FIG. 7. The upper shaft 35 is affixed to the arms 36 and 36', also, so that rotation of the drive gear 38 about the upper gear 37 will impart rotation via the shaft 35 and arms 36 and 36' to the pulley 34.

As illustrated in FIGS. 8 to 13, a hand grip assembly 48 is rotationally supported on a shaft 49 extending through opposite ends of a yoke 50, the yoke mounted at the forward end of an adjustment mechanism 52 which is suspended from an angle bracket 53 on the lower gear 38. Briefly, the hand grip 48 is .rotatable about the common axis through shoulder bolts 49, and the yoke 50 is rotatable about an axis perpendicular to the shoulder bolt 49 which axis extends through the longitudinal axis of the adjustment mechanism 52, to be hereinafter described in more detail, thereby permitting supination, pronation and freedom of wrist position of the exerciser's hands in lifting through the range of movement illustrated in FIG. 7. This lifting is performed against the inertial resistance of the resistance system which is translated through the cable 20 to each of the drive pulleys 34.

Figure 2:
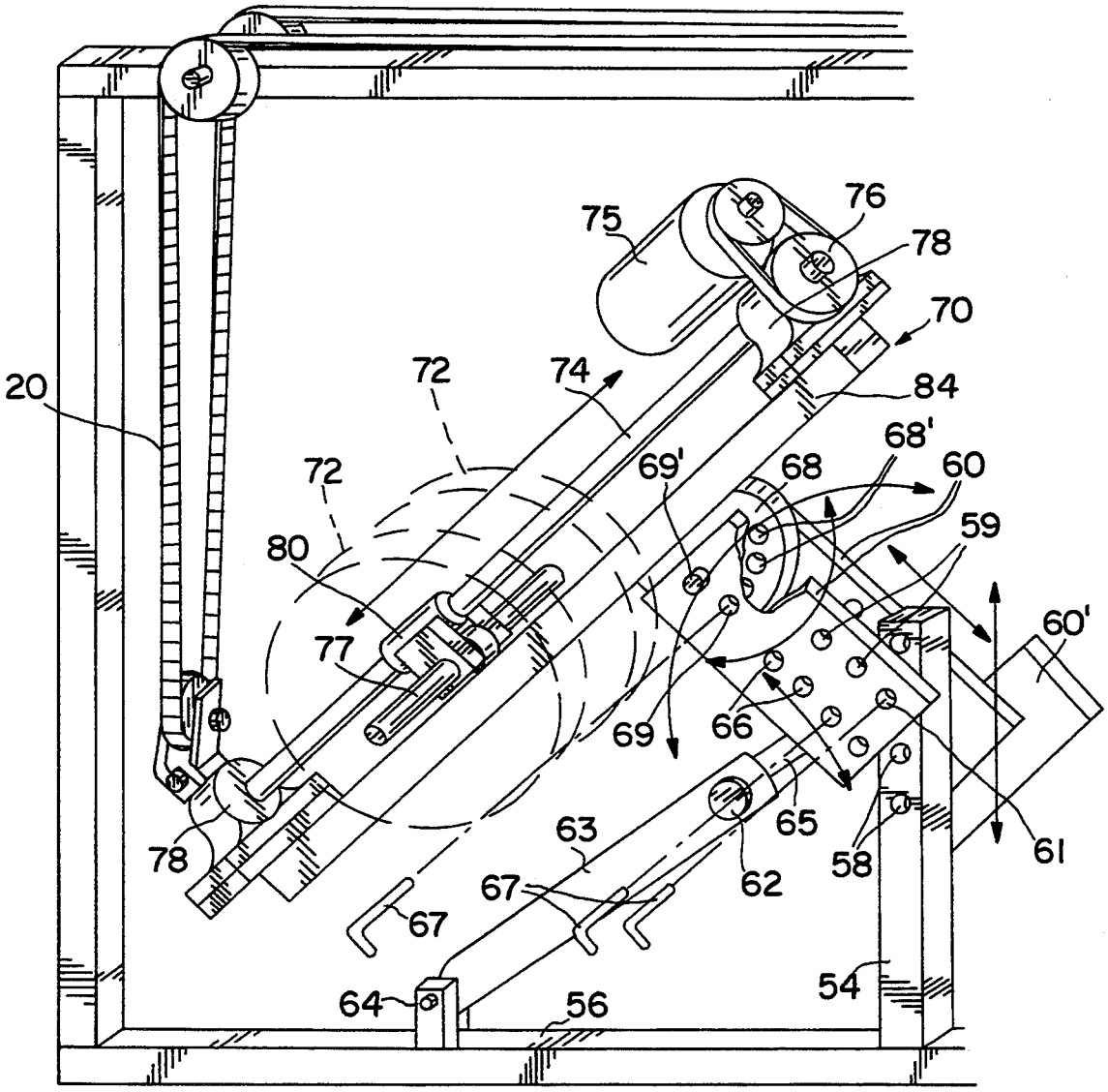
FIG. 2 is an enlarged fragmentary side view of a portion of the resistance system of the preferred form of exercising apparatus in accordance with the present invention.

An important feature of the present invention resides in the disposition and arrangement of the resistance system and its ability to generate different moment of force profiles best suited to the idiosyncratic resistance needs of the athlete. To this end the resistance system comprises the cable 20, a support post 54 on base 56 of the frame 12, and the post including a series of vertically spaced holes 58 for pivotal connection of spaced, parallel leg members 60. Another series of vertically spaced holes 59 is provided to establish pivotal connection of the leg members 60 to the post 54, for example, as designated at the pivot point 61. A dashpot or dampener 63 with pressure adjustment knob 63' has a lower cylinder end 62 pivotally attached at 64 to the base 56, and an upper rod end 65 is pivotally connected to one of a series of holes 66 on the leg members 60, as best seen from FIG. 2. Generally L-shaped pin connectors 67, illustrated in exploded form in FIGS. 1 and 2, are provided for pivotal connection of the rod end 65 to one of the holes 66 as well as for connection of the leg member 60.

The leg members 60 include counterweight 60' to offset the force applied by actuator assembly 70; and a roller member 68 with a shaft 69' journaled between upper ends of the leg members 60 in the upper one of two sets of openings 69; and a pin 67 is inserted through the lower of the openings and an aligned hole 68' in the member 68 thereby to support a linear actuator unit 70 for pivotal movement about the post 54. Insertion of one of the pins 67 through a selected opening 68' as described will enable adjustments in the angle between the linear actuator unit 70 and leg pair 60 to establish the desired angular relationship between the members. The unit 70 controls translatory movement of weights 72 along a drive screw 74, the latter being driven by motor 75 through a speed reducer 76 at one end of the screw 74. The opposite end of the screw is journaled to a bearing 78 which rests on a base frame 84. The weights 72 are releasably positioned on a weight bar 79 suspended by a worm 80 on the screw 74, and a roller 82 is rotatable along the base frame 84, the latter being supported by the roller 68 at the upper end of the leg member 60. The characteristics and features of the resistance system can be best appreciated from a consideration of FIGS. 3 to 6 and associated graphs FIGS. 3A, 4A, 5A and 6A which illustrate the moment of force profiles for different positions of the adjustable elements of the resistance system in imposing a predetermined resistance to each cycle of double joint muscle movement, for example, as illustrated in FIG. 7. Thus, when the athlete is in a seated position on the seat rest 14, the seat rest 14 can be vertically adjusted until the center of rotation at the shoulder is generally across from the axle 35 with the arms of the athlete hanging straight and downwardly with the hands curled around the hand grips 48. In performing a biceps curl, the athlete's arms will be constrained to follow the pivotal movement of the arm pairs 36 on each side of the cross frame whereby to supinate or pronate and flex the forearms about the elbows as well as to flex the upper arms about the shoulders until the hands reach the raised position illustrated in dotted form in FIG. 7. In traversing this range of movement, the lower drive gear 38 is rotated about the upper drive gear against the resistance of the pulley 34 and associated cable 20. The amount or degree of resistance is determined by the amount of weight placed on the weight bar 79 and the moment arm of that weight about the pivot point 61 between the leg members 60 and post 54. The resistance can as an option be further influenced by the dampening force applied by the dashpot 62, in a manner to be described, in connection with FIGS. 3 to 6.

Figure 3:
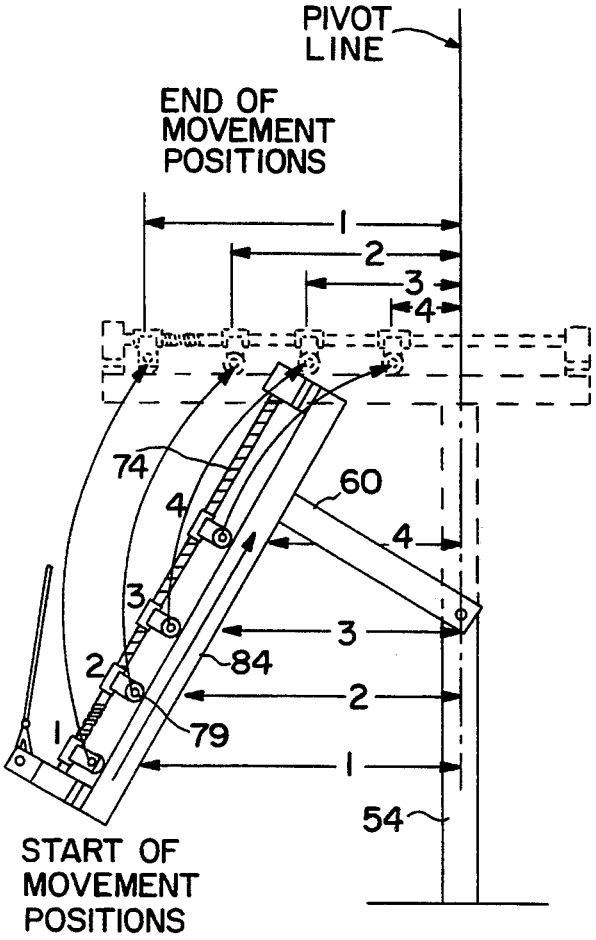
FIG. 3 is a schematic view of changes in position of a linear actuator in combination with moment arms extending from a base support, forming a part of the resistance system of the present invention.
Figure 3A:
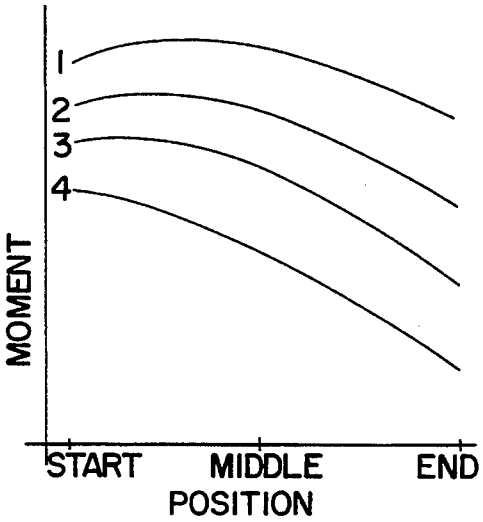
FIG. 3A is a graph depicting changing moment profiles resulting from changes in position of the linear actuator as illustrated in FIG. 3.

Specifically referring to FIG. 3, by virtue of the mutually perpendicular relationship between the leg pair 60 and base frame 84, translatory movement of the weight bar 79 along the drive screw 74 will initially determine the moment arm between the weights 72 and post 54. Thus, FIG. 3 illustrates four different positions of the weight bar 79 with the linear actuator 70 at the downwardly inclined starting position at the beginning of concentric muscle movement; and further illustrates in dotted form the linear actuator at the end of a range of concentric muscle movement. For each given position of the weight bar 79 at positions "1", "2", "3" and "4" of FIG. 3A illustrates the moment of force resistance curve as the linear actuator 70 advances upwardly in resisting the concentric muscle movement of the arms. Generally, as can be seen from FIG. 3A, the inertial resistance may or may not be increased through the middle arc of movement of the exercise, then may gradually lessen toward the end of the cycle when the hands have reached the uppermost limit of movement shown in FIG. 7 and as the weight is moved along beam 84 on successive repetitions, as shown in positions "2", "3", "4", the moment of force at the ends of each movement will decrease more than the decreases at the start of the same repetitions.

Figure 4:
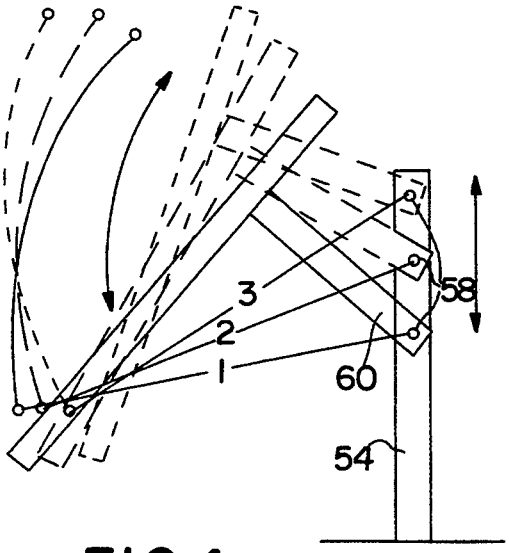
FIG. 4 is a schematic view illustrating changes in position of a vertical pivot member of the resistance system.
Figure 4A:
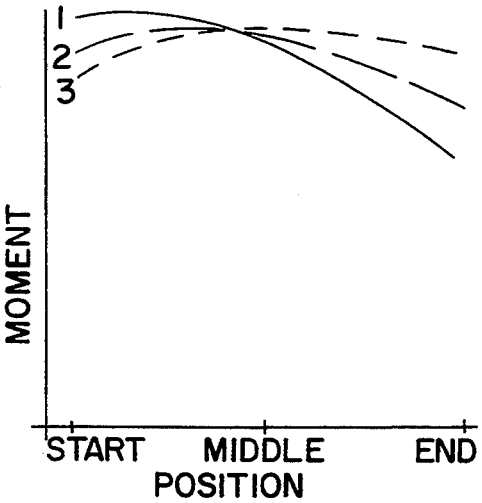
FIG. 4A is a graph depicting force moment changes resulting from changes in position of the vertical pivot illustrated in FIG. 4.

FIG. 4 illustrates the effect on the resistance curve when the connection of the leg pair 60 to the post 54 is adjusted or repositioned with respect to the openings 58. In general, the higher the openings selected, the greater the initial angle of inclination of the linear actuator with respect to horizontal. As represented in FIG. 4A, position 1 represents the profile or curve when the legs 60 are attached at the lowermost position on the post thereby increasing the initial resistance and causing it to more rapidly lessen toward the end of the exercise. As the pivot point is raised for a given exercise, it can be seen that the initial resistance will be lessened at the beginning of the movement but increased through the intermediate range and end of the movement.

Figure 5:
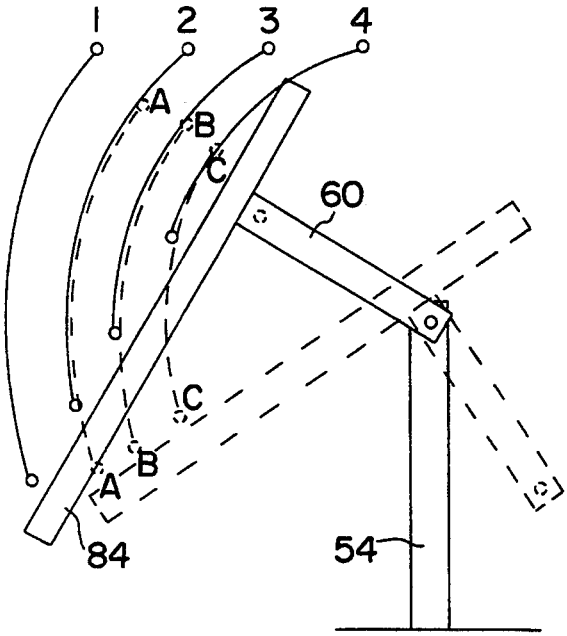
FIG. 5 is a schematic view illustrating changes in position of a pivot point of a leg attached to the linear actuator of the resistance system of the present invention.
Figure 5A:
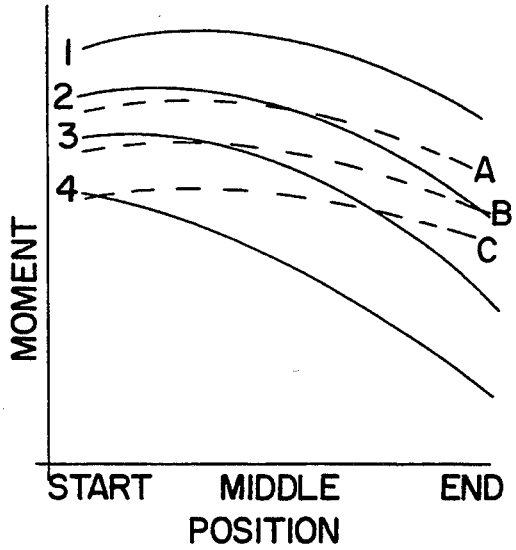
FIG. 5A is a graph illustrating moment of force changes resulting from changes in position of the leg member illustrated in FIG. 5.

FIG. 5 illustrates the effect of shifting the pivotal connection of one of the openings 59 on the leg pair 60 to a given opening 58 on the post 54. In essence, as the leg pair 60 is progressively lowered or effectively shortened with respect to the post 54, the moment arm between the weight bar 79 and post 54 is shortened so as to impose less overall resistance to the exercise; and in addition the resistance itself will be more uniform but may be lessened somewhat toward the end of the exercise.

Figure 6:
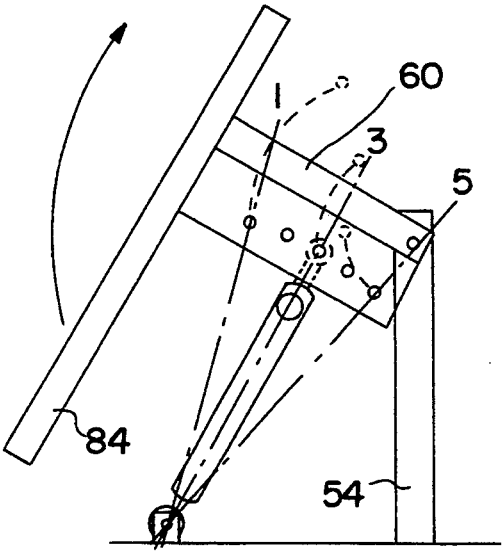
FIG. 6 is a schematic view illustrating changes in position between a dashpot and the linear actuator leg of the resistance system of the present invention.
Figure 6A:
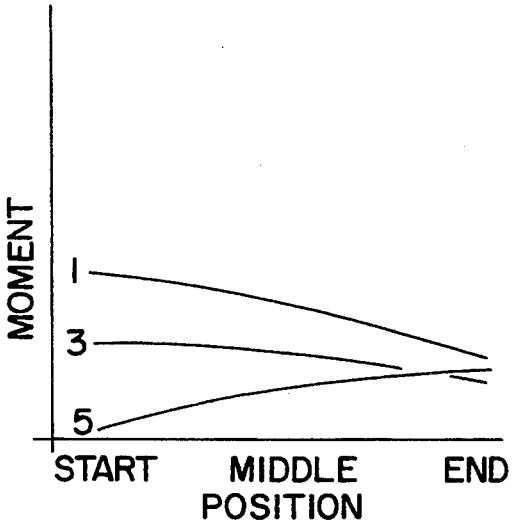
FIG. 6A illustrates different moment position curves for the changes in position of the dashpot illustrated in FIG. 6.

Referring to FIGS. 6 and 6A, when the dashpot connection via rod end 65 to one of the openings 66 in the leg 60 is shifted between positions "1", "3" and "5", the amount of dampening force or resistance will be progressively reduced at the start of the exercise, as illustrated in FIG. 6A, but undergo different variations as the exercise progresses. For instance, in position "5", resistance will gradually increase to a level at the end of the exercise substantially the same as the reduced resistance level at position "1".

Figure 12:
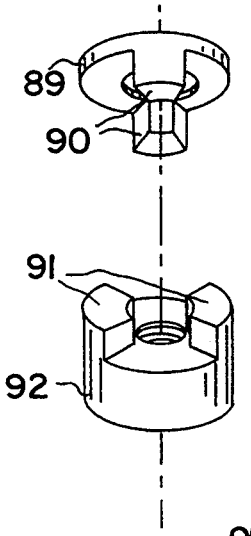
FIG. 12 is an exploded view of a nut and washer forming a part of the hand grip unit of FIG. 11.
Figure 13:
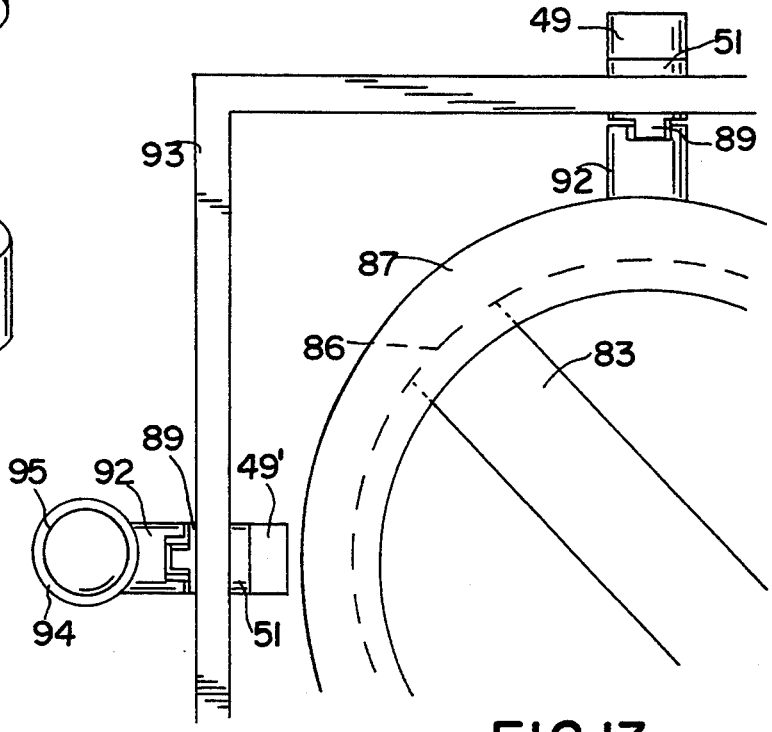
FIG. 13 is an enlarged top plan view of a portion of the hand grip shown in FIGS. 8, 8A and 9.

Referring to FIGS. 8 to 13, there is illustrated in more detail the preferred construction and arrangement of the hand grip assembly 48 and its mounting with respect to the gear 38. It will be noted from FIG. 12 that the hand grip is in the form of a diametrically extending rod attached at opposite ends to a ring member 86 which is slidable within an outer ring-like bushing member 87 so that the grip 48 is free to rotate about an axis passing through the center of the ring 86, i.e., in the direction of the arrows illustrated in FIG. 10. The outer bushing member 87 is suspended between opposite sides 88 of the yoke 50 by the shoulder bolts 49, each bolt 49 having a bushing 51 and including a caged washer 89 affixed to side 88 at its inner end having forwardly projecting, diametrically opposed ribs 90 which interengage with diametrically opposed ribs 91 on caged nut 92, as shown in FIG. 12. Each of the caged nuts 92 is affixed to the bushing 87 and projects in an outward radial direction to interengage with one of the washers 89, and the ribs 90 are undersized with respect to the circumferential spacing between the ribs 91 to permit limited rotational movement of the hand grip assembly about an axis through the shoulder bolts 49; i.e., in the direction of the arrows illustrated in FIG. 8 above and below the hand grip 48. Another shoulder bolt assembly as represented at 49' serves to interconnect cross portion 93 of the yoke 50 and the adjustment mechanism 52, and like elements to those of the shoulder bolt assembly 49 are correspondingly enumerated. In this relation, the shoulder bolt assembly 49 through the cross member 93 of the yoke will permit limited rotation of the hand grip 48 about an axis through the shoulder bolt assembly 49'. The shoulder bolt assembly 49' through the cross member 93 forms the central support for the yoke 50 with respect to the adjustment mechanism 52, the latter having an outer sleeve 94 to which the nut 92 is permanently attached, such as, by welding. The outer tube or sleeve 94 is disposed in surrounding relation to a central shaft 95 which is pivotally attached as at 96 to the bracket 53.

Figure 8A:
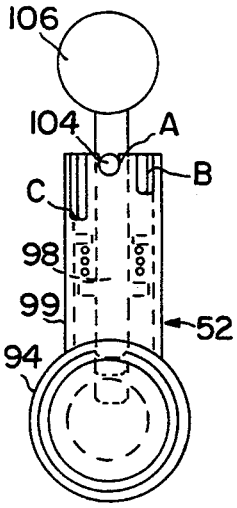
FIG. 8A is an enlarged view in more detail of the hand grip portion of the exerciser shown in FIG. 8.
Figure 10:
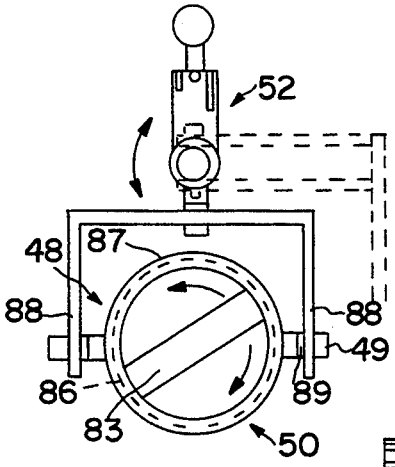
FIG. 10 is a top plan view in detail of the hand grip portion of the exerciser shown in FIGS. 8 and 9.
Figure 8:
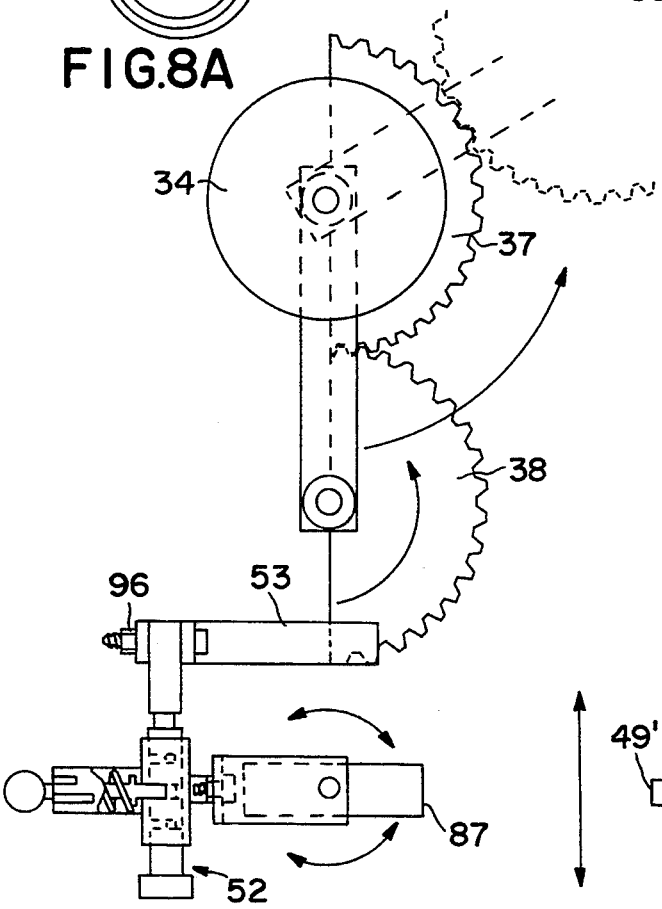
FIG. 8 is a side view in detail of a portion of the range of movement exerciser illustrating rotational movement of the gear mechanism.
Figure 9:
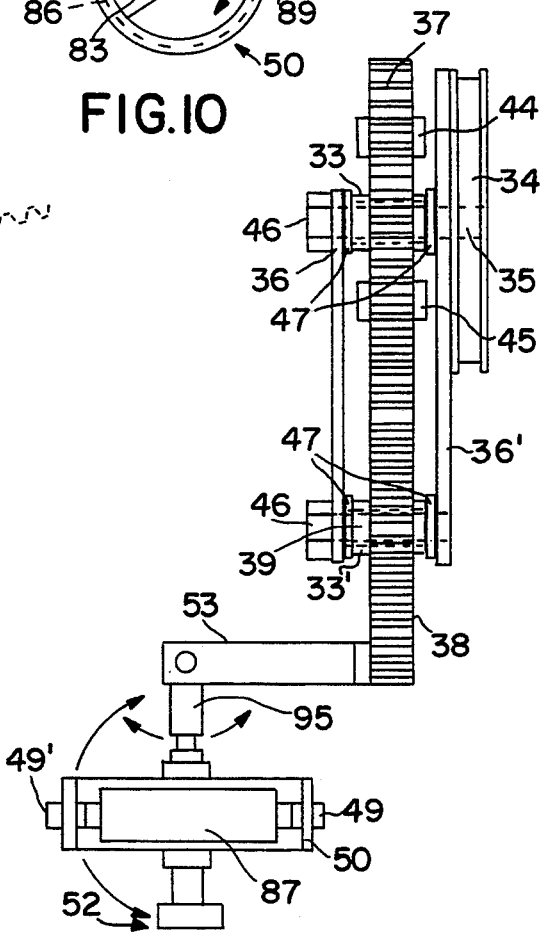
FIG. 9 is a front view in elevation of the portion of the exerciser illustrated in FIG. 8.
Figure 11:
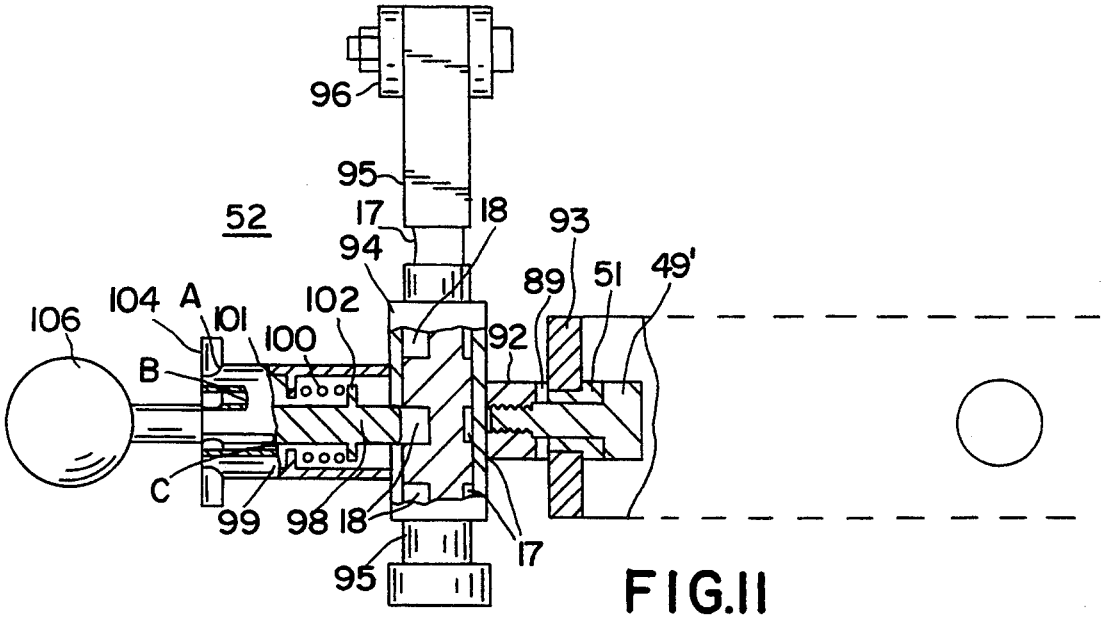
FIG. 11 is an enlarged view with portions broken away and in section of the adjustment portion of the hand grip illustrated in FIGS. 8, 8A and 9.

In order to control the degree of rotation and axial positioning of the hand grip assembly 48 with respect to the shaft 95, a plunger 98 is mounted within the housing 99 for extension through aligned openings between the sleeve 94 and shaft 95. The plunger 98 is spring-loaded with respect to the housing 99 by a spring member 100 interposed between limit stop 101 on the housing and stop 102 on the plunger to normally urge the plunger in a radial inward direction into the aligned openings; however, the depth of penetration is regulated by a crossbar 104 on the plunger 98 and which is movable into and out of registry with a series of three sets of diametrically opposed slots designated at A, B and C, each pair of slots being of a different depth as best seen from FIGS. 8A and 11. In turn, the shaft 95 is provided with circumferential grooves 17 at axially spaced intervals on the external surface thereof, and a bore or hole 18 extends radially through each slot to a depth near the center or longitudinal axis of the shaft. Accordingly, when the cross member 104 is inserted into the slot C, the plunger 98 is free to extend into one of the bores 18 so as to prevent relative rotation between the sleeve 94 and the shaft 95. When the cross member 104 is inserted into slots B, the plunger 98 will extend only through the sleeve 94 and into the slot 17 but not penetrate the bore 18 so as to permit relative rotation between the sleeve 94 and shaft 95 but prevent any relative axial movement between the members 94 and 95. Still further, when the cross member 104 is inserted into the shallower slots A, the plunger 98 will be retracted to the full line position shown in FIG. 8A outside of the slot 17 so that the sleeve 94 is free to move both axially and rotationally with respect to shaft 95 and can be repositioned, for example, to accommodate different arm lengths of different exercisers. A knob 106 at the end of the plunger 98 can be grasped and manipulated to position the cross member 104 in the desired slots A, B or C as described.

In use, the athlete will place the desired amount of weights on the weight bar 79 and adjust the moment arm by advancing the weight bar 79 to the desired starting position as illustrated in FIG. 3 and selecting the desired pivot point 61 between the leg members 60 and the post 54, as shown in FIG. 5. Vertical adjustment of the leg members 60 with respect to the post 54 may be made as illustrated in FIG. 4 to influence the moment of force profile in the manner illustrated in FIG. 4A. Again, the resistance offered by the dashpot 62 can be adjusted as shown in FIG. 6 so that, for example, when in position 5 minimal resistance is offered at the beginning of the cycle to a maximum point at the end of the cycle. At the opposite extreme, connection to the leg members 60 at the first position adjacent to the linear actuator will substantially increase the resistance at the beginning of the cycle and progressively fall toward the end of the cycle when the arms are in their uppermost or raised position as shown in FIG. 7. As the athlete lowers or returns the arm to the starting position for the beginning of the next cycle, the weight of the linear actuator will cause it to return to the lower position as the pulley 34 is rotated in a direction unwinding the cable 22. It should be apparent that both level and shape of resistance can be manipulated by position and pressure settings of the dashpot. The dashpot can then as an option be used to influence the shape of resistance, control any flywheel effects, limit the range of movement or various combinations of the above. In this relation, a preferred form of a cable is manufactured and sold by Bridon American rope Corporation of Denver, Colo.

It is to be understood that various modifications may be made in the construction and arrangement of parts comprising the preferred form of invention without departing from the spirit and scope thereof. For example, threaded adjustment may be utilized in place of providing a series of holes to adjust the various pivot points and such adjustments may be made by program control with the assistance of a computer to produce different desired force profiles according to the needs of the exerciser or athlete. In addition, a cam or eccentric member can be employed in place of each of the drive pulleys 34 to vary the force profile of the system. Moreover, the resistance system of the present invention is readily adaptable for use in performing exercises other than the double joint muscle movement exercise as described, and conversely, the biceps curl double joint exerciser could be used in combination with other resistance systems without departing from the spirit and scope of the present invention, all as defined by the appended claims and reasonable equivalents thereof.

I claim:

1. In weight lifting apparatus wherein a lift device is engageable by an exerciser and is movable through a predetermined range of movement, the improvement comprising:

a flexible resistance member for applying a selected amount of resistance to movement of said device, said resistance member affixed at one end to said device, a dampener member disposed at an opposite end of said resistance member;

at least one pivotal arm member interposed between said dampener and said resistance member to establish a predetermined level of resistance to movement of said device;

adjusting means between said arm member and said resistance member to vary the level of resistance to movement of said device including a fixed support member, and pivot means for pivotally connecting said arm member to said fixed support member to establish a fulcrum about which said arm member is pivoted in response to movement of said resistance member; and means for adjustably connecting said arm member to said support member whereby to adjust the length of a moment arm established between said cable and said support member.

2. In apparatus according to claim 1, said resistance member including a cable attachable to one of said arm portions, said adjusting means including linear force actuating means between said cable and said one of said arm portions.

3. In apparatus according to claim 1, said dampener being connected to said one arm portion in offset relation to said fulcrum, and means for shifting the point of attachment of said dampener to said one arm member.

4. In weight lifting apparatus wherein a lift device is engageable by an exerciser and is movable through a predetermined range of movement, the improvement comprising:

a resistance member for applying a selected amount of resistance to movement of said device, said resistance member including a cable affixed at one end to said device and linear force actuating means being secured to an opposite end of said cable, a fixed support member, said actuating means including substantially perpendicular arm members interposed between said support member and said cable, and means for adjustably connecting one of said arm members to said support member whereby to adjust the length of a moment arm established between said cable and said support member.

5. In apparatus according to claim 4, including pivot means for pivotally connecting one of said arm members to said fixed support member whereby to establish a fulcrum about which said arm members are pivoted in response to movement of said device.

6. In apparatus according to claim 4, the other of said arm members including a weight member disposed thereon, and means for shifting the position of said weight member with respect to said other arm member whereby to change the amount of resistance to movement of said device.

7. In apparatus according to claim 6, said weight member including weight supporting means for releasably supporting a plurality of weights on said other arm member, and said shifting means including a threaded actuator member for advancing said weight support means along said other arm member.

8. Exercise apparatus for human exerciser to perform bicep curls in which arms of the exerciser are lifted from a position hanging freely down on opposite sides of the body to a raised overhead position comprising:

a pair of hand grip members; and means suspending said grip members on opposite sides of the exerciser, said suspension means including rotational support means constraining the arms to rotate upwardly about the shoulders together with upward bending of the forearms about the elbows as said grip members are grasped in each hand of the exerciser and swung upwardly about said suspension means to a raised position over the head of the exerciser, said rotational support means including upper and lower intermeshing gears, and means operatively connecting said grip members to said lower gears whereby upward movement of said grip members causes said lower gears to undergo planetary rotation about said upper gears.

9. Exercise apparatus according to claim 8, said rotational support means including resistance means to impose a predetermined resistance to lifting of said grip members.

10. Exercise apparatus according to claim 9, said resistance means imposing a predetermined resistance to movement of said lower gear about said upper gear.

11. Exercise apparatus according to claim 8, said grip members including means for adjustably connecting each of said grip members to said rotational support means to conform to the arm length of said exerciser.

12. Exercise apparatus according to claim 11, including means for rotationally mounting said grip members for pronation and supination of the arms of the exerciser in raising said grip members to the overhead position, and means for limiting rotational movement of said grip members.

13. Weight lifting apparatus adapted for a human exerciser to perform double joint muscle movements comprising:

a frame including a seat rest at one end of said frame;

a pair of hand grip members, means suspending said grip members on opposite sides of said exerciser when seated upon said seat rest, said suspension means including rotational support means constraining the arms of the exerciser for movement upwardly about the shoulders and simultaneous upward bending of the forearms about the elbows when the exerciser swings the hand grips upwardly, said rotational support means including upper and lower intermeshing gears, and means operatively connecting said grip members to said lower gears whereby upward movement of said grip members causes said lower gears to undergo planetary rotation about said upper gears; and a resistance member for applying a selected amount of resistance to movement of said grip members, said resistance member fixed at one end to said rotational support means and a dampener at an opposite end of said resistance member to said rotational support means, at least one pivotal arm member disposed between said dampener and said resistance member to establish a predetermined level of resistance to movement of said grip members, a fixed support member, and adjusting means between said arm member and said support member to vary the level of resistance to movement of said grip members by said exerciser in performing double joint movements by adjusting the length of a moment arm established between said resistance member and said support member.

14. Weight lifting apparatus according to claim 13, said resistance member including an elongated flexible but non-elastic cable affixed at one end to said rotational support means, and linear force actuating means secured to an opposite end of said cable.

15. Weight lifting apparatus according to claim 13, wherein said pivotal arm members are interposed between said fixed support member and said actuating means, and said adjusting means including means for shifting the effective point of attachment of said pivotal arm member to said fixed support member.

16. Weight lifting apparatus according to claim 13, said actuating means including a weight member, and means for shifting the position of said weight member with respect to said pivotal arm member, said pivotal arm member extending perpendicular to said actuating means.

17. Weight lifting apparatus according to claim 13, wherein means are provided for shifting the point of attachment of said dampener to said pivotal arm member.

18. Weight lifting apparatus according to claim 14, wherein means are provided for adjusting the angular relationship between said pivotal arm member and said actuating means.

* * * * *